US006710671B1

(12) United States Patent
Tanaka

(10) Patent No.: US 6,710,671 B1
(45) Date of Patent: Mar. 23, 2004

(54) NONRECIPROCAL CIRCUIT DEVICE AND METHOD OF FABRICATING THE SAME

(75) Inventor: Yasuhiro Tanaka, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/605,789

(22) Filed: Jun. 27, 2000

(30) Foreign Application Priority Data

Jun. 28, 1999 (JP) ..... 11-181906

(51) Int. Cl.[7] ..... H01P 1/32
(52) U.S. Cl. ..... 333/1.1; 333/24.2
(58) Field of Search ..... 333/1.1, 242

(56) References Cited

U.S. PATENT DOCUMENTS 5,498,999 A * 3/1996 Marusawa et al. ..... 333/1.1
5,653,841 A * 8/1997 Krishnamurthy et al. .... 333/1.1 X

FOREIGN PATENT DOCUMENTS

| | | | |
|---|---|---|---|
| JP | 09-294006 | * 11/1997 | ..... H01P/1/36 |
| JP | 9-326606 | 12/1997 | ..... H01P/1/383 |
| JP | 10-270917 | 10/1998 | ..... H01P/1/383 |

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

A nonreciprocal circuit device includes a laminate include a magnetic substrate composed of a ferromagnetic material, a permanent-magnet substrate laminated on the magnetic substrate, and a plurality of central conductors dispose on one of the upper surface and the lower surface of the magnetic substrate, a yoke integrated into the laminate, and a network formed within the laminate and electrically connected to any one of the plurality of central conductors.

11 Claims, 8 Drawing Sheets

NONRECIPROCAL CIRCUIT DEVICE AND METHOD OF FABRICATING THE SAME

BACKGROUND OF THE INVENTION

1. Field of the Invention

The present invention relates to nonreciprocal circuit devices, such as isolators and circulators, and to a method of fabricating the same. More particularly, the invention relates to a nonreciprocal circuit device in which a plurality of components are integrated and a method of fabricating the same.

2. Description of the Related Art

Various types of isolators and circulators have been disclosed as high-frequency nonreciprocal circuit devices. An example of a conventional isolator will be described with reference to FIGS. 7 and 8.

In the fabrication process of an isolator, a plurality of central conductors 52 to 54 are placed on the upper surface of a ferrite substrate 51. The central conductors 52 to 54 intersect each other in the center while being electrically insulated from each other.

The integrated structure in which the central conductors 52 to 54 intersect each other is referred to as "a net". A permanent-magnet plate 55 is deposited on the ferrite substrate 51 with the net therebetween. Capacitors 56*a* to 56*c* and a resistor 57 are also mounted so as to be electrically connected to the central conductors 52 to 54. The capacitors 56*a* to 56*c* and the resistor 57 may be disposed in various manners. After the components shown in FIG. 7 are assembled, the integrated unit is contained in a base 58 shown in FIG. 8. A magnetic cap 59 coated with a conductive film is placed on the base 58. A yoke 60 composed of a metal plate or the like is also mounted so as to be magnetically coupled to the cap 59.

As described above, with respect to the conventional isolator, many components must be prepared and assembled, resulting in difficulty in improving productivity and reliability.

Consequently, various attempts have been made to integrate a plurality of components constituting a nonreciprocal circuit device.

For example, Japanese Unexamined Patent Application Publication No. 8-222912 discloses a nonreciprocal circuit device using a sintered compact formed by integrally firing a laminate in which a green sheet for a magnetic member and a green sheet for a permanent magnet are laminated with a central conductor therebetween. The central conductor, the magnetic member, and the permanent magnet are formed into a single sintered compact using an integrating firing technique. The sintered compact is provided with a recess for receiving a magnetic yoke.

Japanese Unexamined Patent Application Publication No. 8-330812 discloses a method of fabricating a lumped-constant circulator, in which ferrimagnetic thin plates provided with central conductors printed thereon are laminated, and the resulting laminate is cut off, followed by firing. That is, the individual laminates, each corresponding to a lumped-constant circulator unit, are separated from a mother laminate, and by firing the laminates, structures in which central conductors and magnetic members are integrated are obtained.

Japanese Unexamined Patent Application Publication No. 9-326606 discloses a nonreciprocal circuit device in which a central conductor and capacitor electrodes constituting a capacitor are disposed within a sintered compact composed of a magnetic material.

As described above, various types of structure, in which a plurality of components of a nonreciprocal circuit device are integrated using an integrating firing technique or the like, have been disclosed. However, with respect to the conventional nonreciprocal circuit devices, although an attempt is made to integrate a plurality of components, preparation and assembly of many components are still required.

For example, in Japanese Unexamined Patent Application Publication No. 8-222912, although the magnetic member, the central conductor, and the permanent magnet are integrated using the integrating firing technique, the magnetic yoke must be separately prepared and be mounted on the laminate obtained using the integrating firing technique.

With respect to the lumped-constant circulator disclosed in Japanese Unexamined Patent Application Publication No. 8-330812, only the ferrimagnetic thin plates and the central conductors are integrated. That is, a permanent magnet, a magnetic yoke, etc., must be prepared as separate components, which must be assembled together with the sintered compact.

With respect to the nonreciprocal circuit device disclosed in Japanese Unexamined Patent Application Publication No. 9-326606, although the central conductor and the electrodes constituting the capacitor to be connected to the central conductor are integrally fired with the magnetic body, other components, such as a permanent magnet and a magnetic yoke, must be prepared separately and be mounted on the sintered compact.

SUMMARY OF THE INVENTION

Accordingly, the present invention resolve the several drawbacks as described above, and it is an object of the present invention to provide a nonreciprocal circuit device in which more components, including a network provided with elements such as a capacitor, can be integrated, thus efficiently improving productivity and reliability, and to provide a method of fabricating the same.

In accordance with the present invention, a nonreciprocal circuit device includes a laminated body including a magnetic substrate composed of a ferromagnetic material, a permanent-magnet substrate laminated on the magnetic substrate, a plurality of central conductors disposed on the upper surface or the lower surface of the magnetic substrate, the central conductors intersecting each other in the center while being electrically insulated from each other, and a yoke integrated into the laminated body, and a network provided within the laminated body and electrically connected to any one of the plurality of central conductors.

Preferably, the nonreciprocal circuit device further includes a dielectric substrate laminated on the magnetic substrate opposite to the permanent-magnet substrate, and the network is disposed on at least one surface of at least one of the magnetic substrate, the permanent-magnet substrate, and the dielectric substrate, and is electrically connected to any one of the central conductors.

Preferably, in the nonreciprocal circuit device, the network includes a capacitor electrode electrically connected to one end of any one of the central conductors, and a ground electrode provided on the lower surface of the laminated body. The capacitor electrode and the ground electrode constitute a capacitor.

Preferably, the yoke is constructed by a magnetic film covering the outer surface of the laminated body. Further, according to another aspect of the invention, the nonreciprocal circuit device includes a second magnetic substrate laminated on the lower surface of the laminated body, and a magnetic case coupled to the second magnetic substrate; the magnetic case covers the upper surface, the lower surface and side surfaces of the laminated body.

In accordance with the present invention, a method of fabricating the nonreciprocal circuit device includes the steps of preparing a mother magnetic substrate and a mother permanent-magnet substrate; forming an electrode for forming the network on at least one surface of at least one of the mother permanent-magnet substrate and the mother magnetic substrate; laminating the mother magnetic substrate, the mother permanent-magnet substrate, and a plurality of central conductors by an adhesive to obtain a mother laminated body; cutting the mother laminated body in the thickness direction to obtain laminated bodies corresponding to the individual nonreciprocal circuit devices; and integrating the yoke into each laminated body.

BRIEF DESCRIPTION OF THE DRAWINGS

FIG. 1A is a schematic perspective view showing an electrode structure formed within a laminated body, and FIG. 1B is a perspective view showing the appearance of the laminated body;

FIG. 5A shows a laminated body, FIG. 5B shows a magnetic case, FIG. 5C shows a nonreciprocal circuit device, and FIG. 5D shows a second magnetic substrate;

DESCRIPTION OF THE PREFERRED EMBODIMENTS

Nonreciprocal circuit devices and methods of fabricating the same will be described with reference to the drawings.

Figure 1A:
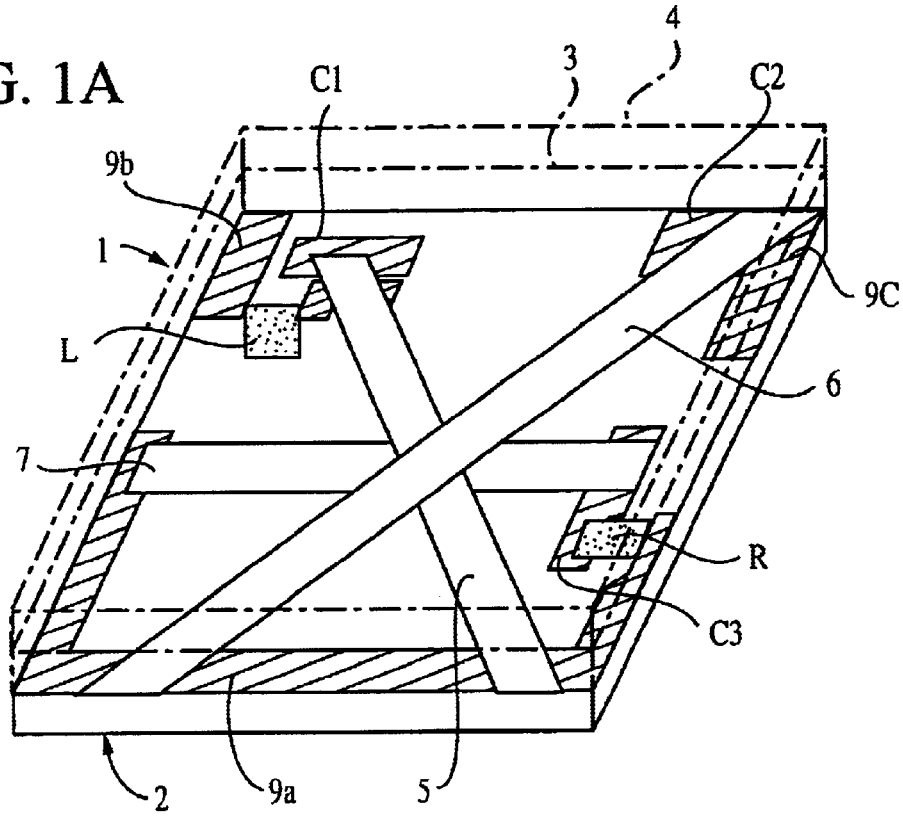
FIGS. 1A and 1B are diagrams showing major portions of a nonreciprocal circuit device in an embodiment of the present invention.
Figure 1B:
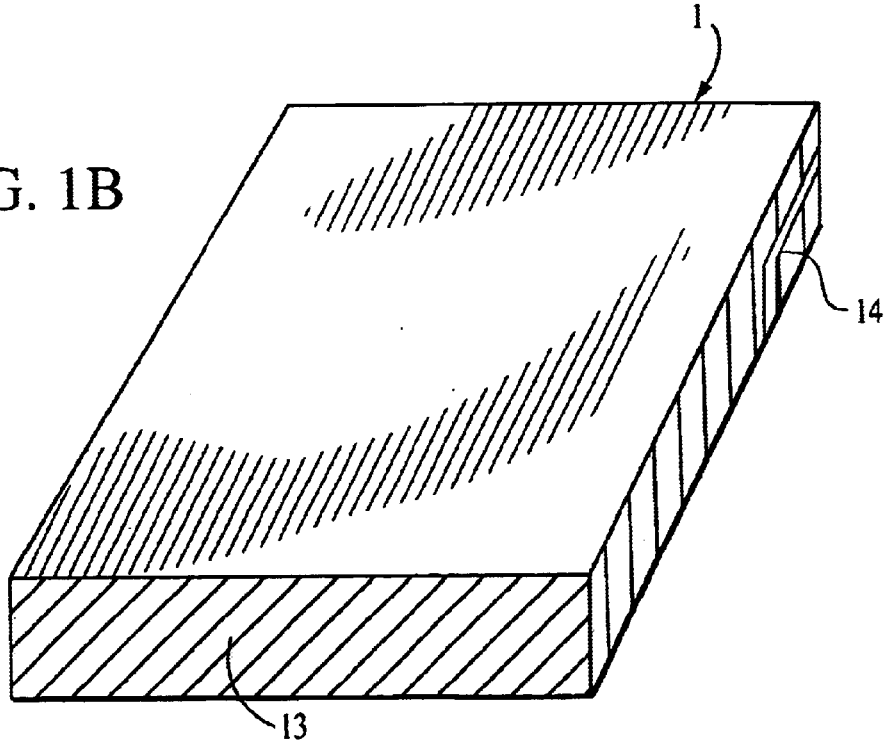

FIG. 1A is a schematic perspective view showing a major portion of a nonreciprocal circuit device in an embodiment of the present invention, and FIG. 1B is a perspective view showing the appearance of a laminated body excluding a magnetic yoke.

The nonreciprocal circuit device in this embodiment is used as an isolator and includes a laminated body 1 shown in FIGS. 1A and 1B.

The laminated body 1 includes a dielectric substrate 2, a ferrite substrate 3 as a magnetic substrate, and a permanent-magnet substrate 4. A plurality of central conductors 5 to 7 are disposed on the upper surface of the dielectric substrate 2 so as to be electrically insulated from each other and to intersect each other in the center. Capacitor electrodes C1 to C3 are formed on the upper surface of the dielectric substrate 2 so as to be electrically connected to the central conductors 5 to 7. An inductor L and a resistor R are formed on the upper surface of the dielectric substrate 2. A method of fabricating the electrode structure to be formed on the upper surface of the m dielectric substrate 2 will be described.

Figure 3A:
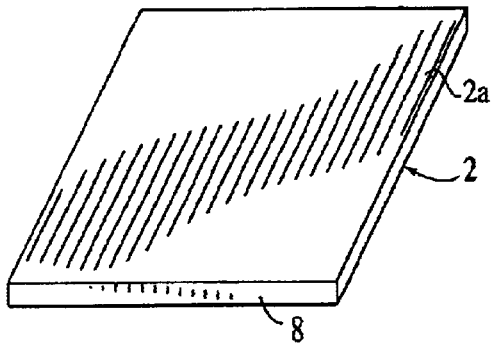
FIGS. 3A to 3D are perspective views showing the individual steps of forming the electrode structure on a dielectric substrate in the embodiment of the present invention.

As shown in FIG. 3A, first, the dielectric substrate 2 is prepared.

Figure 3B:
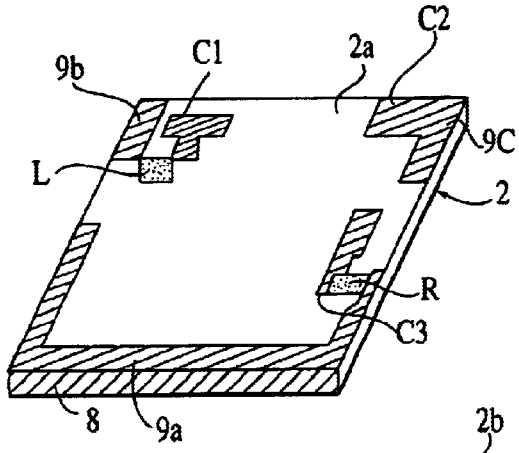

As shown in FIG. 3B, the capacitor electrodes C1 to C3, connecting electrodes 9*a* to 9*c*, and the inductor L are formed on an upper surface 2*a* of the dielectric substrate 2, using a conductive material.

Figure 3C:
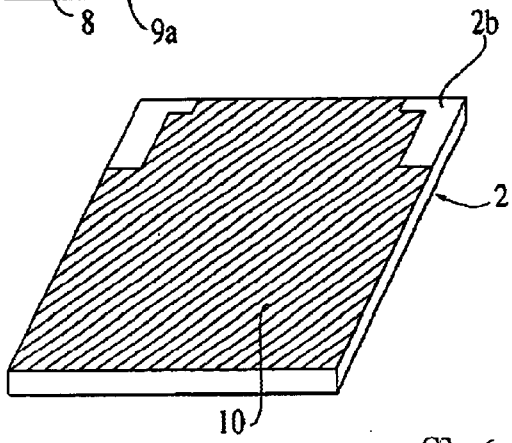

As shown in FIG. 3C, a back-surface electrode 10 is formed over substantially the entire portion of a lower surface 2*b* of the dielectric substrate 2. The back-surface electrode 10 and the capacitor electrodes C1 to C3 are opposed to each other with the dielectric substrate 2 therebetween. In this way, a capacitor is constructed between each of the capacitor electrodes C1 to C3 and the back-surface electrode 10.

Additionally, methods for fabricating the connecting electrodes 9*a* to 9*c*, the capacitor electrodes C1 to C3, the inductor L, and the back-surface electrode 10 are not specifically limited, and photolithography, screen-printing of a conductive paste, and the like may be employed.

Next, a resistive paste is applied so as to be electrically connected to the capacitor electrode C3 and the connecting electrode 9*a*, followed by baking to form the resistor R. A connecting electrode 8 is further formed on the side of the dielectric substrate 2. The connecting electrode 9*a* and the back-surface electrode 10 are electrically connected to each other by the connecting electrode 8.

Figure 3D:
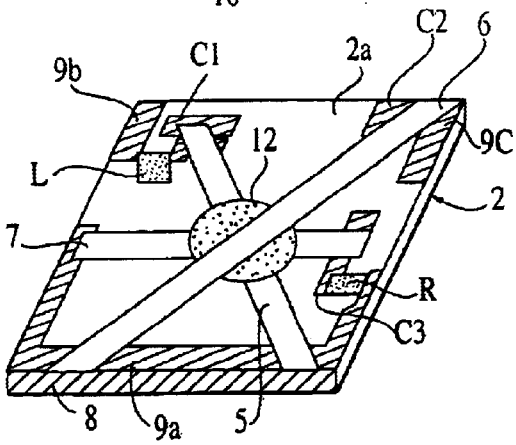

As shown in FIG. 3D, the central conductors 5 to 7 are then laminated on the dielectric substrate 2. In order to electrically insulate the central conductors 5 to 7 from each other, an insulator 12 is interposed between the central conductors 5 to 7 at the intersection of the central conductors 5 to 7 in the center. As the insulator 12, a ceramic, glass, a metal, an oxide, an insulating resin sheet, or an insulating adhesive may be used.

The dielectric substrate 2 shown in FIG. 1 is thus obtained. The ferrite substrate 3 is laminated on the upper surface of the dielectric substrate 2 and is integrated, by an insulating adhesive. The permanent-magnet substrate 4 is further laminated on the upper surface of the ferrite substrate 3 and is integrated, by an insulating adhesive.

Figure 2:
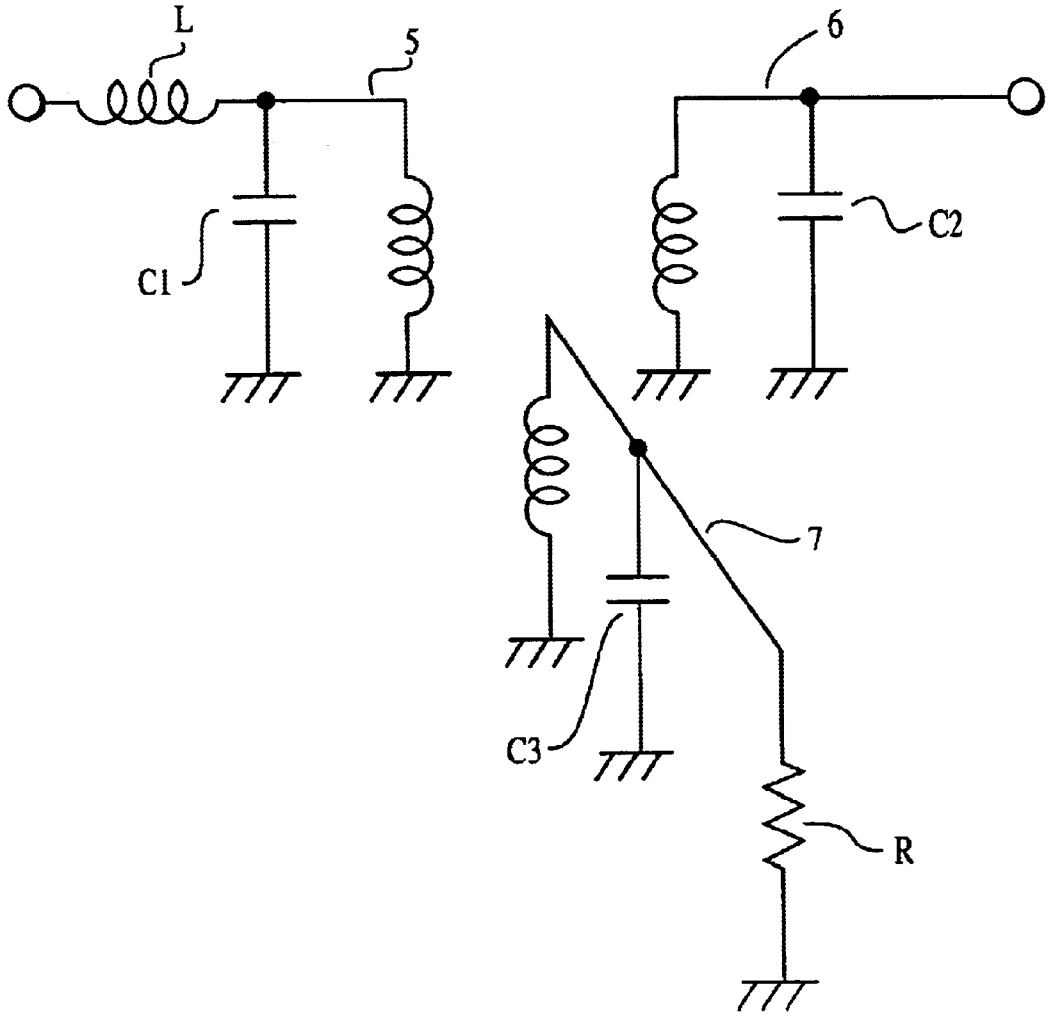
FIG. 2 is a circuit diagram showing the circuit configuration provided on the laminated body in the embodiment of the present invention.

Accordingly, in the laminated body 1, the circuit configuration shown in FIG. 2 is constructed. That is, the networks including the capacitors C1 to C3, and the resistor R, or the inductor L are electrically connected to the central conductors 5 to 7 constituting the nonreciprocal circuit device.

In the nonreciprocal circuit device in this embodiment, the central conductors, the permanent magnet, the magnetic member, and the networks electrically connected to the central conductors are integrated in the laminated body 1.

As shown in FIG. 1B, a common electrode 13, an input electrode (not shown in the drawing), and an output electrode 14 are formed on the outer sides of the laminated body 1. The common electrode 13 is electrically connected to the central conductors 5 to 7, and is connected to the ground potential. The output electrode 14 is electrically connected to an end of the central conductor 6 opposite to the other end thereof electrically connected to the common electrode 13. The input electrode is formed on a side surface of the laminated body 1 opposite to the side surface in which the output electrode 14 is formed, and is electrically connected to the end of the central conductor 5 via the inductor L and the connecting electrode 9*b*.

Figure 4:
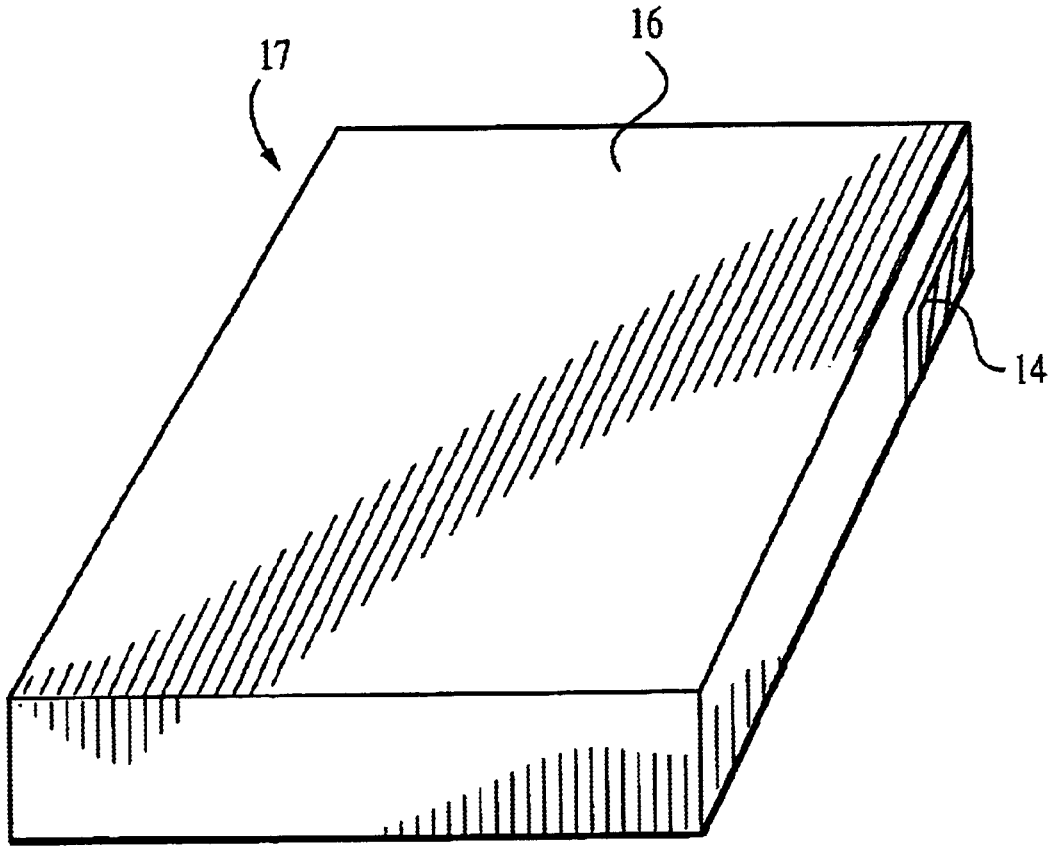
FIG. 4 is a perspective view of the nonreciprocal circuit device in the embodiment of the present invention.

Next, as shown in FIG. 4, a magnetic yoke 16 is constructed by forming a conductive film over the outer surface of the laminated body 1, excluding the input electrode and the output electrode 14, so as not to be electrically connected to the input electrode and the output electrode 14. The method of forming the conductive film constituting the magnetic yoke 16 is not specifically limited, and a thin film deposition method, such as plating, vapor deposition, or sputtering, coating of a conductive paste, or the like may be employed.

Consequently, in a nonreciprocal circuit device 17 shown in FIG. 4, many components constituting the nonreciprocal circuit device are integrated into a single component. That is, the dielectric substrate 2, the ferrite substrate 3, the permanent-magnet substrate 4, the central conductors 5 to 7, as well as the capacitors C1 to C3, the resistor R, and the inductor L constituting the networks, and the magnetic yoke 16 are integrated.

Moreover, when the nonreciprocal circuit device 17 is fabricated, after the laminated body 1 is obtained, only by forming the conductive film, the magnetic yoke 16 is integrated, and thus complex operations, such as physical assembly of a plurality of components, either manually or mechanically, can be omitted, resulting in an improvement in productivity and reliability of the nonreciprocal circuit device.

The magnetic yoke may be formed by a different method. An example of such a method will be described with reference to FIGS. 5A to 5C.

Figure 5A:
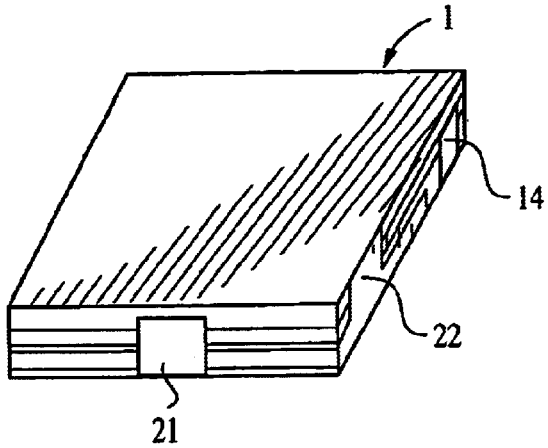
FIGS. 5A to 5D are perspective views illustrating a method of forming a magnetic yoke in the present invention.

As shown in FIG. 5A, connecting electrodes 21 and 22 are formed on the outer surface of the laminated body 1. The connecting electrodes 21 and 22 act in a manner similar to that of the connecting electrode 8 shown in FIG. 3. That is, the connecting electrodes 21 and 22 merely electrically connects a plurality of electrodes to be connected to the ground potential.

Figure 5B:
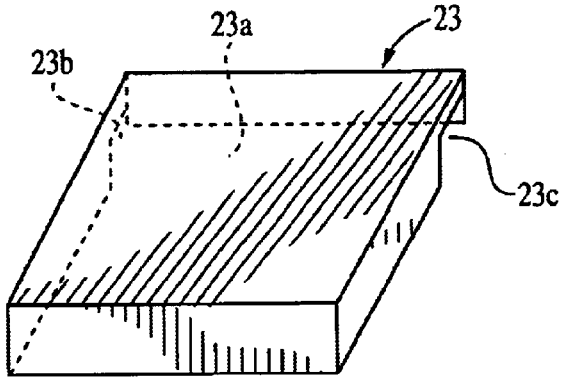

Next, a magnetic case 23 shown in FIG. 5B is placed on the laminated body 1. The magnetic case 23 is composed of a magnetic material, and the outer surface thereof is coated with a conductive film. The magnetic case 23 is provided with an opening 23*a* which is open downward and cut-outs 23*b* and 23*c* for electrically disconnecting from the input and output electrodes.

Figure 5C:
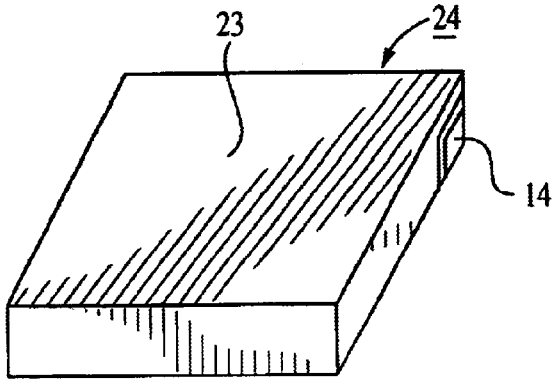

While the magnetic case 23 is placed on the laminated body 1, the magnetic case 23 and the connecting electrodes 21 and 22 are electrically connected each other by soldering or the like. In this way, a magnetic yoke can be constructed by the magnetic case 23. That is, the magnetic yoke can be integrated into the laminated body 1. FIG. 5C shows an isolator 24 thus obtained.

Figure 5D:
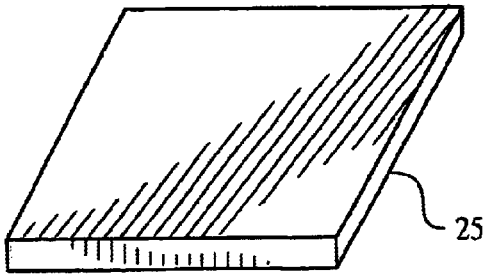

Although the magnetic yoke is constructed by the magnetic case 23 in the example described above, a second magnetic substrate 25 shown in FIG. 5D may further be used. That is, the magnetic-substrate 25 is fixed on the lower surface of the laminated body 1 by an insulating adhesive or the like. The magnetic substrate 25 is then electrically connected to the magnetic case 23, thus constituting a closed magnetic circuit to form a magnetic yoke.

In the nonreciprocal circuit device shown in FIGS. 5A to 5D, since the magnetic yoke comprising the magnetic case 23 is also integrated into the laminated body, a structure in which the dielectric substrate 2, the ferrite substrate 3, the permanent-magnet substrate 4, as well as the network comprising the capacitor electrodes C1 to C3, the resistor R, and the inductor L, and the magnetic yoke are integrated can be obtained. Thus, complex operations, such as assembling a plurality of components manually, can be unnecessary, resulting in an improvement in productivity and reliability of the nonreciprocal circuit device.

Figure 6A:
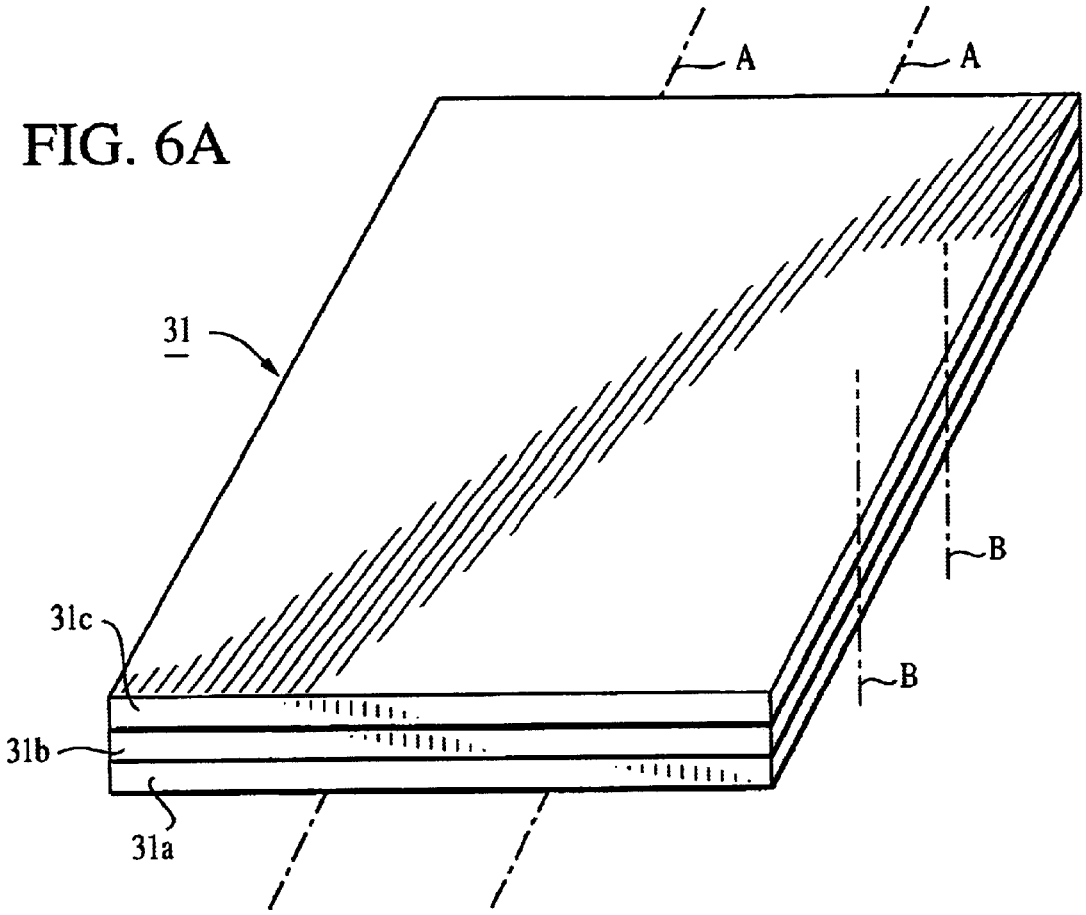
FIGS. 6A and 6B are perspective views showing a mother laminated body prepared and a laminated body obtained by cutting the mother laminated body, respectively, in accordance with a method of fabricating the nonreciprocal circuit device in the embodiment.
Figure 6B:
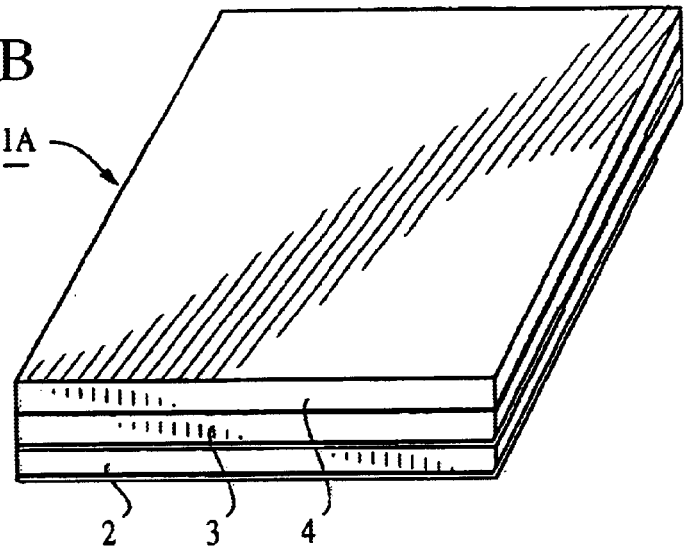
Figure 7:
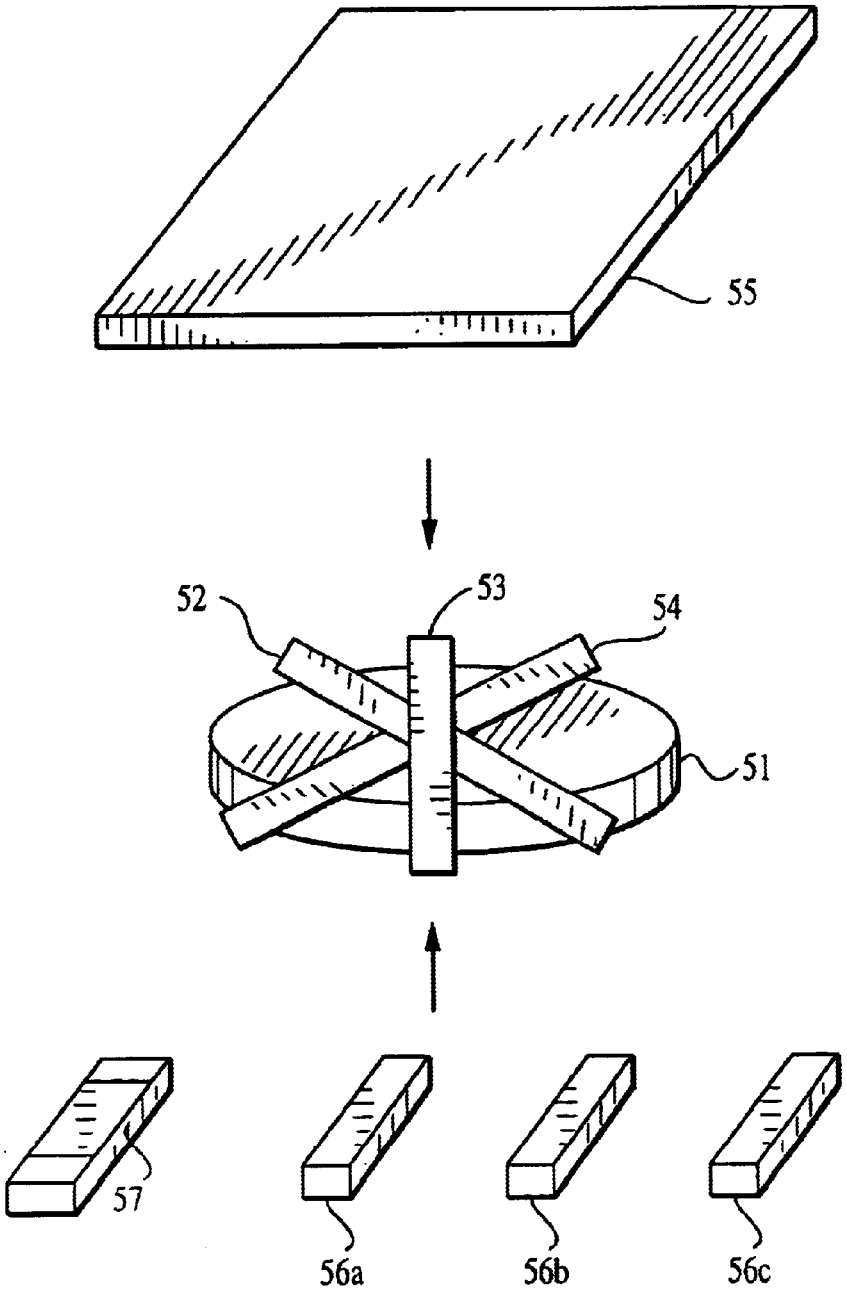
FIG.7 PRIOR ART
FIG. 7 is an assembly view showing an example of a method of fabricating a conventional nonreciprocal circuit device.
Figure 8:
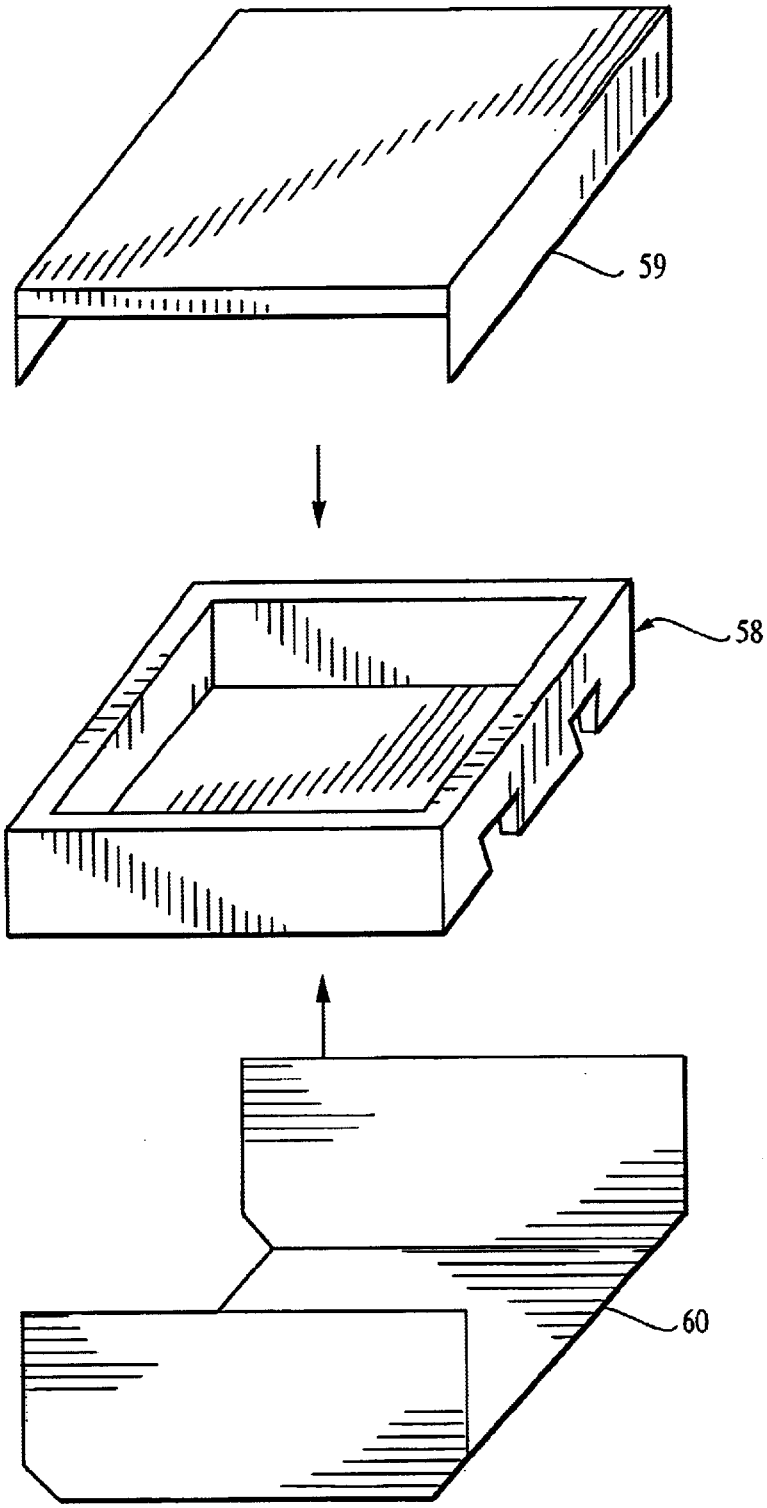
FIG. 8 PRIOR ART
FIG. 8 is an assembly view showing the example of the method of fabricating the conventional nonreciprocal circuit device.

In order to fabricate the laminated body 1 shown in FIG. 1, preferably, after a mother laminated body is obtained, the mother laminated body is cut in the thickness direction, and thus, many laminated bodies 1 can be efficiently fabricated. That is, as shown in FIG. 6A, a mother laminated body 31 provided with a mother dielectric substrate 31*a*, a mother ferrite substrate 31*b*, and a mother permanent-magnet substrate 31*c* is prepared, and by cutting the mother laminated body 31 in the thickness direction along dotted-chain lines A and B, laminated bodies may be obtained. In this way, a laminated body 1A shown in FIG. 6B is obtained. Since the laminated body 1A is obtained by cutting the mother laminated body 31, connecting electrodes are still not formed on the sides thereof. Consequently, after the laminated body 1A is obtained, by forming connecting electrodes by a thin film deposition method, such as vapor deposition, plating, or sputtering, coating of a conductive paste, or the like, the laminated body 1 shown in FIG. 1 can be obtained.

Although the dielectric substrate 2 is used in the embodiment, it is not always necessary to use the dielectric substrate 2 in the present invention. That is, the electrode structure formed on the upper surface of the dielectric substrate 2 in the previous embodiment may be disposed on the upper surface of the ferrite substrate 3 instead of the dielectric substrate, and thus the dielectric substrate 2 may not be used. In such a case, in a laminated body in which the ferrite substrate 3 and the permanent-magnet substrate 4 are laminated, a plurality of central conductors, the magnetic substrate, the permanent-magnet substrate, and the individual electrodes constituting the networks are integrated.

The magnetic material for constituting the magnetic yoke is not specifically limited, and Fe, Co, Ni, Mn, Cr, or alloys thereof may be used. When the magnetic member constituting the magnetic shield is electrically conductive, the magnetic member acts as an electrical shield in addition to acting as the magnetic shield.

However, since the magnetic materials described above do not always have superior electrical conductivity, preferably, the surface of the magnetic member is further coated with a metal having superior electrical conductivity, such as Ag, Cu, Au, or Al.

As described above, in accordance with the present invention, a nonreciprocal circuit device of the present invention includes a laminated body including a magnetic substrate composed of a ferromagnetic material, a permanent-magnet substrate laminated on the magnetic substrate, a plurality of central conductors disposed on the upper surface or the lower surface of the magnetic substrate, the central conductors intersecting each other in the center while being electrically insulated from each other, and a yoke integrated into the laminated body, and a network formed within the laminated body and electrically connected to any one of the plurality of central conductors. Thus, all the components are integrated. Accordingly, while complex operations, such as physically assembling a plurality of components manually, mechanically, or the like, must be performed with respect to the conventional nonreciprocal circuit device, more components can be integrated in the present invention, thus improving productivity and reliability.

In the conventional nonreciprocal circuit device, when the size is reduced, alignment among components is troublesome. In contrast, in the nonreciprocal circuit device of the present invention, since many components are integrated, even when the size is reduced, the troublesome alignment step can be omitted.

In the present invention, when a dielectric substrate is laminated on the magnetic substrate opposite to the permanent-magnet substrate, and the network is provided on at least one surface of at least one of the magnetic substrate, the permanent-magnet substrate, and the dielectric substrate, the network including a capacitor and the like can be easily constructed using the dielectric substrate.

When the network includes a capacitor electrode electrically connected to one end of any one of the central conductors, and a ground electrode formed on the lower surface of the laminated body, and the capacitor electrode and the ground electrode constitute a capacitor, since the capacitor is constructed by the laminated body, a capacitor as a separate component can be omitted.

When the yoke is composed of a magnetic film covering the outer surface of the laminated body, since the yoke is formed only by constructing the magnetic film on the surface of the laminated body, the complex assembly process can be omitted when the yoke is fabricated.

In accordance with a method of fabricating the nonreciprocal circuit device of the present invention, a mother magnetic substrate and a mother permanent-magnet substrate are prepared, an electrode for forming the network is formed on at least one surface of at least one of the mother permanent-magnet substrate and the mother magnetic substrate, and the mother magnetic substrate and the mother permanent-magnet substrate are laminated using an adhesive so that the plurality of central conductors are placed on the upper surface or the lower surface of the magnetic substrate, and thus a mother laminated body is obtained. By cutting the mother laminated body in the thickness direction, laminated bodies corresponding to the individual nonreciprocal circuit devices can be obtained. By integrating the yoke into each laminated body, the nonreciprocal circuit device of the present invention can be obtained efficiently.

That is, since the process up to the step of obtaining the laminated body can be performed in the state of the mother substrate, the productivity of the nonreciprocal circuit device can be further improved.

What is claimed is:

1. A nonreciprocal circuit device comprising:

a laminated body having an upper surface, a lower surface and side surfaces and comprising a magnetic substrate made of a ferromagnetic material, a permanent-magnet substrate laminated on the magnetic substrate, and a plurality of central conductors disposed on the magnetic substrate, the plurality of central conductors intersecting each other in a central area of the laminated body while being electrically insulated from each other;

a yoke integrated into the laminated body; and an electrical component provided within the laminated body and electrically connected to one of the plurality of central conductor; wherein said electrical component is formed on an upper surface of a dielectric substrate in said laminated body, said yoke is defined by a magnetic material layer laminated on the upper surface, the lower surface, and the side surface of said laminated body; and an electrode is laminated on a portion of the upper surface, the lower surface or the side surface of said laminated body.

2. A nonreciprocal circuit device according to claim 1, wherein said dielectric substrate is laminated on a side of the magnetic substrate opposite to the side on which the permanent-magnet substrate is laminated.

3. A nonreciprocal circuit device according to claim 2, wherein the component includes a capacitor electrode electrically to one end of any one of the central conductors and a ground electrode formed on the lower surface of the laminated body, and the capacitor electrode and the ground electrode constitute a capacitor.

4. A nonreciprocal circuit device according to claim 3, wherein the yoke comprises a magnetic film covering the outer surface of the laminated body.

5. A nonreciprocal circuit device according to claim 2, wherein the yoke comprises a magnetic film covering the outer surface of the laminated body.

6. A nonreciprocal circuit device according to claim 1, wherein the component includes a capacitor electrode electrically to one end of any one of the central conductors and a ground electrode formed on the lower surface of the laminated body, and the capacitor electrode and the ground electrode constitute a capacitor.

7. A nonreciprocal circuit device according to claim 6, wherein the yoke comprises a magnetic film covering the outer surface of the laminated body.

8. A nonreciprocal circuit device according to claim 1, wherein the yoke comprises a magnetic film covering the outer surface of the laminated body.

9. A nonreciprocal circuit device according to claim 1, further including a common electrode disposed on said laminated body and electrically connected in common to said plurality of central conductors and to ground.

10. A nonreciprocal circuit device according to claim 1, wherein said laminated body is defined by said dielectric layer, said magnetic substrate disposed on said dielectric layer, and said permanent-magnet substrate disposed on said magnetic substrate, and said yoke is arranged to cover the upper surface the lower surface, and the side surfaces of said laminated body.

11. A nonreciprocal circuit device according to claim 1, wherein said plurality of central conductors and a least one of a resistor and a capacitor are provided on said dielectric substrate.

* * * * *